US005269509A

United States Patent [19]

Cromar et al.

[11] Patent Number: 5,269,509

[45] Date of Patent: Dec. 14, 1993

[54] SHEET REGISTRATION DEVICE

[75] Inventors: Brian D. Cromar, Letchworth; Peter R. Watson, Stevenage, both of United Kingdom

[73] Assignee: Xerox Corporation, Stamford, Conn.

[21] Appl. No.: 939,763

[22] Filed: Sep. 2, 1992

[30] Foreign Application Priority Data

Sep. 11, 1991 [GB] United Kingdom ..... 9119476

[51] Int. Cl.[5] ..... B65H 5/02

[52] U.S. Cl. ..... 271/272; 271/242

[58] Field of Search ..... 271/272, 273, 274, 242, 271/251, 225, 184, 226

[56] References Cited

U.S. PATENT DOCUMENTS

| | | | |
|---|---|---|---|
| 3,915,449 | 10/1975 | Johnson et al. | 271/274 |
| 3,942,789 | 3/1976 | Townsend | 271/274 |
| 4,188,025 | 2/1980 | Gustafson et al. | 271/272 |
| 4,997,179 | 3/1991 | Mizutani et al. | 271/306 |
| 5,022,638 | 6/1991 | Ifkovits | 271/251 |

FOREIGN PATENT DOCUMENTS

| | | | |
|---|---|---|---|
| 0368255 | 5/1990 | European Pat. Off. . | |
| 3-186539 | 8/1991 | Japan | 271/272 |
| 1438924 | 6/1976 | United Kingdom . | |

*Primary Examiner*—H. Grant Skaggs

[57] ABSTRACT

A cut sheet registration device comprises at least two idler rolls biassed into contact with an intermittently-driven feed roll, the idler rolls being pivoted on a bar which is itself pivotable with respect to the axis of the feed roll, so as to adjust the angle which the contact joints of the idler rolls make with the feed roll. The angle of the bar is adjustable at the factory to allow for any misalignment etc. in the downstream sheet-using devices.

5 Claims, 1 Drawing Sheet

SHEET REGISTRATION DEVICE

SHEET REGISTRATION DEVICE

This invention relates to the registration of sheets as they are fed seriatim from a paper module comprising a stack or other supply of sheets to a xerographic printing engine in which images are laid down on the sheets.

After each sheet has been extracted from its stack and has passed along most of its path, it is usually registered immediately before its image of toner is transferred to it and thereafter fused to it.

In such a printer, because of the manufacturing tolerances, variations in assembly, and misalignment of the paper module, the image laid down on the photoreceptor can be out of square with the lead edge on the paper (or other copy medium) sheet on which it is to be deposited and fused.

It is known from United Kingdom specification 1 438 924 that it is old to provide a sheet control apparatus for use in a duplicator for preventing an image of a printing master from being printed onto a copy sheet in such a manner that the longitudinal axis of the image is inclined to the longitudinal axis of the copy sheet.

The present invention aims at providing means for adjustably registering the copy sheets so that after the reprographic machine has been assembled, the copy sheets can be aligned with the deposited images. This is intended to be done at the factory on a pragmatic basis, so that the sheet registration of each printer is aligned with a test pattern representing the images which that printer produces.

Accordingly, the present invention provides a cut sheet registration device that includes at least two idler rolls biased into contact with an intermittently driven feed roll and supported such that they are pivoted on a bar which itself is pivotable with respect to the axis of the feed roll in order to adjust the angle which the contact joints of the idler rolls make with the feed roll to thereby align the copy sheets with images placed thereon from a photoreceptor.

Figure 1:
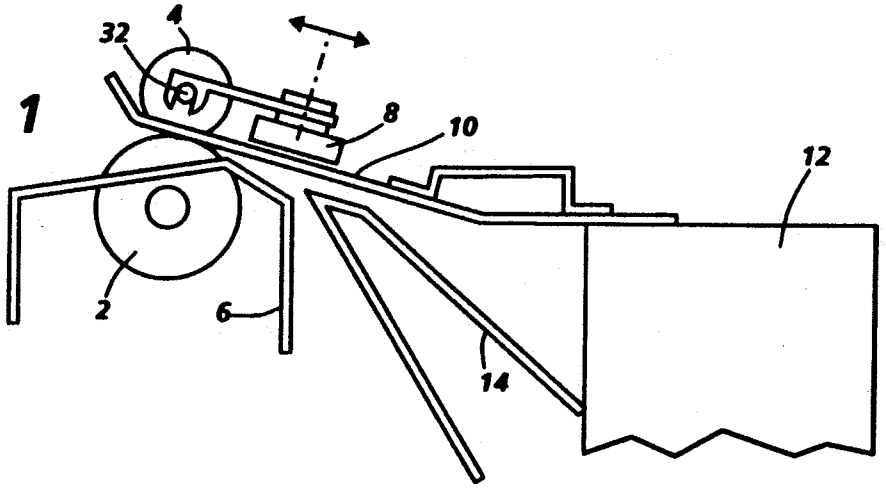
Figure 2:
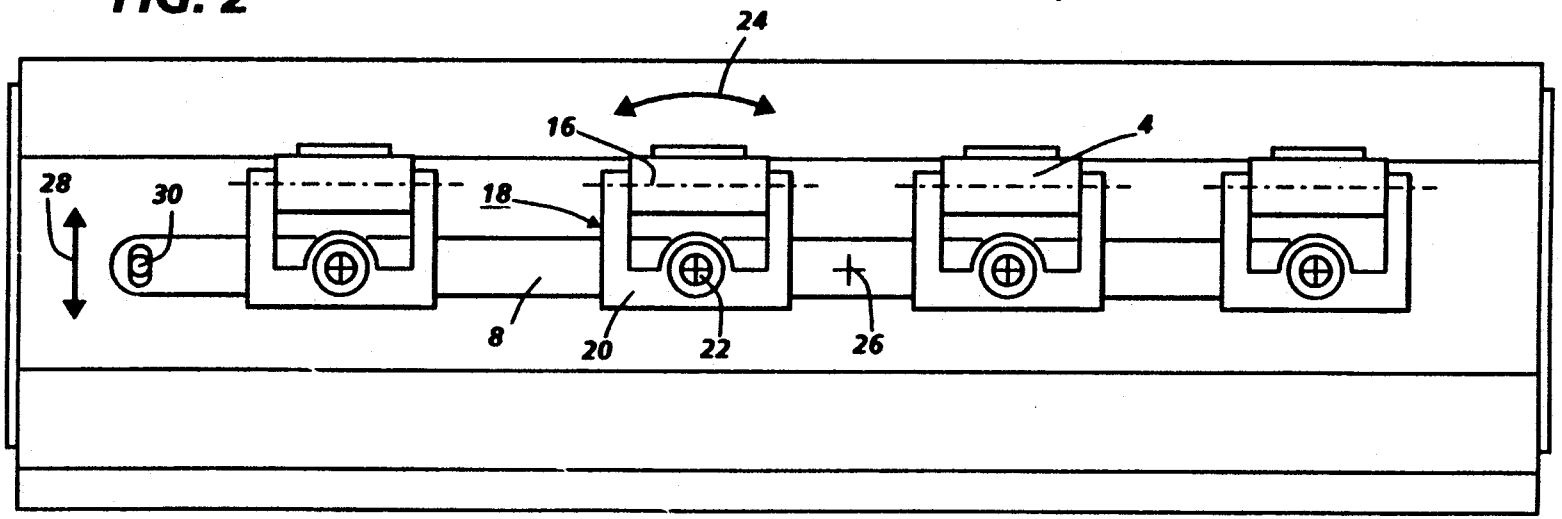

The present invention will now be described by way of example with reference to the accompanying drawings, in which:

FIG. 1 is an end view of one form of registration device of the present invention, and FIG. 2 is a plan view of the device shown in FIG. 1.

As shown in the drawing, an intermittently-driven feed roll 2 is positioned opposite an aligned series of registration rolls 4. The feed roll has a guide 6 associated with it. The rolls 4 are each supported from a bar 8 which is mounted on a guide member 10 which is in turn mounted on a housing 12 for a device for feeding sheets of paper (or other copy medium) from a stack or other supply (not shown). The registration rolls 4 extend through gaps in the guide 10 and rest directly on feed roll 2. Each roll 4 is an idler roll, in that only roll 2 is driven when necessary. The sheet feed throat formed by guides 6 and 10 is complemented by an auxiliary guide 14, so that on leaving housing 12 each sheet has no alternative to having its lead edge brought into contact with the registration 'edge' formed by the aligned nips of the rolls 4 with the roll 2.

As can be seen more easily from FIG. 2, each roll 4 is rotatable about an axis 16 extending between the limbs of a support bracket 18 having its web 20 secured to bar 8 in a manner permitting castor motion of each roll 4 about axis 22, as indicated by arrow 24.

The bar 8 is in turn mounted on guide 10 in a manner permitting limited pivotal movement about axis 26, as indicated by arrow 28. Because of the importance of this movement, one end of bar 8 is extended and is engaged by a retainer 30 extending through an arcuate slot in the bar from the guide 10. The retainer 30 can be loosened to permit adjustment of the angular position of bar 8 about axis 26, and then tightened to keep that setting.

When a sheet of paper or other copy medium is fed from housing 12, it passes along the throat defined by guides 14, 6 and 10 until its lead edge comes into contact with the nip between feed roll 2 and the stalled registration rolls 4. At the time this happens, both the feed and idler rolls are stationary, so that the copy sheet is brought to a halt with its lead edge in contact with all four aligned registration rolls 4 which thus act as an adjustable registration edge. When the device is being calibrated (set up) at the factory, the registered sheet is later fed to a downstream position (not shown) at which a pattern of toner powder is transferred to it from a photoreceptor roll or belt, with the image then being fused to the copy sheet by the application of heat and/or pressure, as is well known in xerography. The image would usually be in the form of a test pattern filling up the whole of the space available for an image so that a physical comparison can be made between the boundaries of the test image pattern and of the copy sheet. What would normally happen would be that the edge of the test pattern closet to the lead edge of the sheet would be checked to see if they were exactly parallel to each other. If this is not the case, then the retainer 30 would be loosened, the bar 8 would be adjusted in the appropriate direction and by the correct amount to bring about exact registration of the copy sheet and image pattern, and the retainer 30 retightened.

Because of the relatively-small angle through which the bar 8 can be pivoted about its axis 26, there is no problem in ensuring even contact of each of the rolls 4 with roll 2. The axis of each roll 4 is always parallel with that of roll 2, because of the castoring action afforded by the manner in which roll 4 is supported on bar 8. Although the individual axes of the rolls 4 may not be collinear, and usually would not be, unless the bar 8 were itself exactly parallel with the axis of roll 2, the slight stagger between the individual axes still provides four spaced-apart points against which the lead edge of the copy sheet can come into contact in order to be registered. By virtue of the fact that each roll 4 has its axle 32 engaged in a downward-facing slot in the respective limb 18 of the mounting bracket, each roll 4 is always biased by gravity into contact with roll 2, so that there is no gap between any roll 4 and roll 2 between which the lead edge of the copy sheet could enter for the feed roll 2 is driven to feed the registered sheets downstream.

We claim:

1. A cut sheet registration device comprising at least one cylindrical driving roll, and a mounting spaced from the roll and carrying a bar having at least two idler rolls mounted on it so as to have their surfaces in rolling contact with the driving roll at distances spaced apart along the axis of the roll by a distance less than the minimum width of a sheet to be fed to the nips between the driving roll and each idler roll, whereby the nips define a registration line on the surface of the driving roll, wherein the driving roll is adapted to be rotated intermittently, being adapted to be driven when a sheet having its lead edge on the registration line is to be fed to a downstream sheet-using device, and to be kept stationary when the stalled idler and driving rolls are to act as a registration device, wherein the bar extends substantially along the length of the driving roll and is pivotable on the mounting so as to adjust the angle of the registration line relative to the axis of the driving roll, and wherein each idler roll is pivotable on the bar individually and separately from said pivoting of said pivoting of said bar on said mounting about an axis which extends transversely of the path of the sheet as it approaches the registration line, so that each idler roll aligns itself with the driving roll by castor action when the rolls are rotated, whereby a cut sheet may be fed from the registration nip with an adjustable skew controlled by the angle which the registration line makes with the direction in which each sheet is fed to and from the device.

2. A registration apparatus for registering and aligning copy sheets prior to their receiving images thereon, comprising:

a drive roll;

a plurality of idler rolls positioned in nip contacting relation with said drive roll;

means for mounting said plurality of idler rolls for individual and separate pivotal movement about a vertical axis with respect to the direction of movement of the copy sheets; and means for mounting said plurality of idler rolls for pivotal movement as a unit within a plane parallel to the direction of movement of the copy sheets in order to properly align the copy sheets with an image to be received thereon.

3. The registration apparatus of claim 2, wherein said means for mounting said idler rolls for individual and separate pivotal movement includes a support bracket and means for supporting said support bracket in a manner permitting castor motion of each of said plurality of idler rolls.

4. The registration apparatus of claim 3, wherein said means for mounting said plurality of drive rolls as a unit includes a bar member.

5. The registration apparatus of claim 4, wherein said bar member is pivotable about an adjustable fastening means located at one end of said bar member.

* * * * *